United States Patent [19]

Mallen et al.

[11] Patent Number: 4,790,907

[45] Date of Patent: Dec. 13, 1988

[54] SYNTHETIC FIBER

[75] Inventors: Ted A. Mallen, Chattanooga; Doyle B. Word, Cleveland, both of Tenn.

[73] Assignee: Intera Company, Ltd., Cleveland, Tenn.

[21] Appl. No.: 80,916

[22] Filed: Aug. 3, 1987

[51] Int. Cl.[4] ..... D21H 5/12

[52] U.S. Cl. ..... 162/157.1; 162/157.2; 162/157.6; 162/158; 162/164.3; 162/182

[58] Field of Search ..... 162/157.1–157.6, 162/182, 158, 164.3; 8/115.6, 115.52, 115.53, 115.56, 181, 194

[56] References Cited

U.S. PATENT DOCUMENTS

| | | | |
|---|---|---|---|
| 2,869,435 | 1/1959 | Sands | 162/157.3 |
| 3,047,355 | 7/1962 | von Brachel | 8/115.56 |
| 3,188,165 | 6/1965 | Magat et al. | 8/115.52 |
| 3,250,664 | 5/1966 | Conte et al. | 162/164.3 |
| 3,650,669 | 3/1972 | Osborn et al. | 8/115.52 |
| 3,670,048 | 6/1972 | Magat et al. | 8/115.52 |
| 3,708,555 | 1/1973 | Gaylord | 162/157.5 |
| 3,779,881 | 12/1973 | Sakurada et al. | 8/115.52 |
| 4,007,250 | 2/1977 | Kimura et al. | 8/115.56 |
| 4,605,612 | 8/1986 | Asao et al. | 162/168.1 |
| 4,749,328 | 6/1988 | Cates | 8/115.56 |

FOREIGN PATENT DOCUMENTS

| | | | |
|---|---|---|---|
| 50-20010 | 3/1975 | Japan | 162/157.6 |

*Primary Examiner*—Peter Chin

*Attorney, Agent, or Firm*—Oblon, Fisher, Spivak, McClelland & Maier

[57] ABSTRACT

The invention is related to a method of making paper or non-woven articles, comprising treating a substrate to render said substrate durably hydrophilic; and forming said durably hydrophilic fiber into a paper or non-woven article.

39 Claims, No Drawings

SYNTHETIC FIBER

BACKGROUND OF THE INVENTION

1. Field of the Invention

The present invention relates to durably hydrophilic synthetic substrates. More specifically, the invention relates to the use of durably hydrophilic synthetic substrates such as fibers and particularly staple fibers for the manufacture of wet-lay non-woven articles and paper, and articles made from these synthetic substrates.

2. Discussion of the Background

The most widely used non-woven fabric is paper made from naturally occurring fibers such as wood pulp or cotton. With the development of synthetic fibers, there has been considerable interest in their use in making non-woven articles and sheet-like structures, using the simple processing steps and equipment commonly employed in paper making from natural fibers.

There are no significant problems associated with the use of synthetic fibers on conventional paper making machinery. The fibers may be slushed or slurried in a conventional manner to disperse the fibers in water. However, the refining of synthetic fibers and pulps is frequently avoided, because certain types of refining equipment can form fiber bundles or knots. These bundles can result in the formation of greas spots in the final sheet due to fusion during the calendering process. High pressures can fuse synthetic fiber bundles even without heat during calendering. Drying operations involving synthetic fibers are frequently more fascile than the drying of cellulose pulps due to the fact that synthetic fibers are generally hydrophobic in nature and have improved drainage and drying characteristics. Care must be taken however, not to use temperatures which are higher than the melting point of the synthetic fibers. Sizing, dyeing and filling operations can be performed in the normal fashion.

Synthetic organic fibers can be manufactured to meet specific diameter, length and physical properties. In addition, synthetic papers have the advantage of high wet strength, toughness, chemical durability, weather resistance and excellent dimensional stability.

Failure of synthetic fibers to replace natural cellulose fibers is due in large part to their hydrophobic nature. In order to use synthetic fibers having satisfactory properties successfully in the manufacture of synthetic or semi-synthetic paper on conventional paper-making equipment, it is essential that the synthethic fibers have a dispersibility in water similar to that of cellulose fibers i.e., they should have hydrophilic properties.

Synthetic pulps, filaments and fibers are all useful for the manufacture of paper articles. Synthetic pulps are designed to be blended in all proportions with wood pulp and can be used with conventional paper-making equipment. Common synthetic materials used in these pulps include high density polyethylene or polypropylene, and aramids, for example Kevlar and Nomex. Pulps prepared from other polymers are also known, e.g., aliphatic polyamides, polyvinylchloride, acrylonitrile homopolymers and copolymers with halogenated monomers, styrene copolymers and mixtures of polymers. Synthetic pulps have very irregular surfaces with many crevices and an almost film-like nature, in contrast to synthetic staples which are smooth rods of synthetic polymer. The surface area of synthetic pulp is quite large, which results in high scattering coefficients and gives rise to high opacity in papers made from these synthetic pulps. Additionally, synthetic pulps generally have lower densities than cellulosic pulps with the result that lighter weight papers can be made from these synthetics. Lighter weight papers represent an economic disadvantage, however, when paper is sold by weight units.

Although synthetic pulps are dispersible in water, they do not absorb water so their dimensions are not effected by contact with liquid water or water vapor. As a result, sheets containing synthetic pulp tend not to change dimension as relatively humidity changes. However, the hydrophobic nature of synthetic pulps frequently results in paper having a lower wet-strength than paper made from cellulosic pulp. Improved water dispersibility or bonding has been effected by precipitation of appropriate materials onto the surface of pulp fibers. Anionic-cationic colloidal complexes have been formed in the presence of synthetic pulp. Preferred complexes are poly(ethylene-co-acrylic acids)-/polyethylene imine and carboxymethyl cellulose/-melamine-formaldehyde resin. A general discussion of synthetic pulps can be found in "The Encyclopedia of Chemical Technology", Kirk-Othmer, Vol. 19, pp. 420–435, John Wiley & Sons, Inc., 1982.

Synthetic fibers have also been used to make paper products. The synthetic fibers may be in the form of continuous filaments or staple fibers and may be optionally mixed with cellulosic fibers and used on conventional paper-making machinery. In order to use synthetic fibers successfully in the manufacture of synthetic or semi-synthetic paper, it is essential that the synthetic fibers have a dispersibility in water similar to that of cellulose fibers which, due to their morphology and chemical nature disperse readily and homogeneously in water. Additionally, the synthetic fibers should have sufficient wet-strength to enable the use of conventional paper-making machinery.

In recent years, a considerable amount of effort has been expended in the development of synthetic fibers having hydrophilic properties. Much of this effort has been directed to treating synthetic fibers with hydrophilic polymeric materials or the development of synthetic fibers possessing hydrophilic chemical groups in the fiber itself. U.S. Pat. Nos. 4,167,548; 4,092,457; 4,002,796; 3,963,821; and 3,928,496 disclose some of these processes.

In general, these processes are directed toward the production of a specific type of synthetic fiber, and do not have general applicability to a wide variety of commercially available synthetic staple fibers. Their utility is therefore limited to the specific fibers involved. There continues to be a need for durably hydrophilic synthetic substrates and particularly staple fibers which are useful in the manufacture of non-woven and paper articles and which can be produced using commercially available staple fibers as a substrate. Non-woven and paper articles produced from virtually any type of synthetic staple fibers and which can be made on conventional paper-making equipment are not currently available and would be highly desirable.

SUMMARY OF THE INVENTION

Accordingly, one object of the present invention is to provide durably hydrophilic synthetic substrates for use in making non-woven and paper articles.

A further object of the invention is to provide durably hydrophilic non-woven and paper articles which are fully absorbent and reusable after drying.

Another object of the invention is to provide durably hydrophilic synthetic staple fibers for use in making non-woven or paper articles which can be used with conventional paper-making equipment.

These and other objects of the present invention which will become apparent from the following specification have been achieved by the hydrophilic substrates and method of the present invention which comprises treating a substrate to render the substrate durably hydrophilic; and forming the durably hydrophilic substrate into a paper or non-woven article.

DESCRIPTION OF THE PREFERRED EMBODIMENTS

By "aqueous mixture" as used herein is meant any aqueous solution, dispersion, suspension, colloidal solution, emulsion or other aqueous physical aggregation containing a water-soluble cross-linking vinyl monomer and a hydrophobic carrier compound. The present invention contemplates not only forming an emulsion of the carrier compound, but also contemplates introducing the carrier into the aqueous medium by any other means, such as by dissolving it in an appropriate solvent to aid formation of a physical dispersion.

The term "synthetic substrate" is used herein in a broad sense, to include substrates in any appropriate physical form such that the substrate can be formed into a paper or non-woven article. A preferred form of the substrate is a fiber, sheet or bundle of fibers, preferably staple fibers. The substrate may be comprised of man-made fibers such as polyesters, polyacrylates, polyamides, polyurethanes, polystyrenes, polyolefins, polycyanoethylenes, polyacrylonitriles, polyvinylalcohols, aramides, such as Nomex® and Kevlar®, and also semi-synthetic substrates composed of regenerated cellulose, such as rayon and cellulose acetate. Although the synthetic substrate may have any appropriate physical form, synthetic substrates in the form of fibers are particularly preferred. While not being limited to the use of fiber substrates, the specification will hereinafter refer to the substrate in the preferred fiber form.

By "hydrophobic carrier compound" is meant a hydrophobic molecule which has a greater affinity for the synthetic substrate than for the surrounding aqueous medium under the conditions of the present invention, and which when employed in the present process, yields a substrate having durable hydrophilic properties. Such compounds are limited to those organic compounds wherein all non-aromatic carbon-carbon bonds are saturated. Thus, excluded from use as carrier compounds are molecules containing the vinyl group ($CH_2{=}CH{-}$), has exemplified by ethylene glycol dimethacrylate, ethoxylated bisphenol A dimethacrylate, allyl acrylate, and other such highly reactive, easily polymerizable monomers which contain at least one vinyl group.

By "durable" as used herein is meant hydrophilic properties which are retained by the substrate throughout the process of forming the paper or non-woven article. By maintaining hydrophilic properties throughout the process of forming the paper and non-woven article, standard paper-making equipment such as that used in the formation of paper from cellulosic materials may be used. The addition of additives to increase the dispersability of the synthetic substrate is therefore not necessary. The degree of durability of hydrophilic properties following the production of the paper or non-woven article is optional. For example, when printing of the articles is desired using water-based or alcohol-based inks, long-term durability is desired to enhance the printability and durability of the printed article. However, for some applications it may be desirable that the hydrophilic properties of the substrate be removed immediately after processing or at some point following the formation of the paper or non-woven article. For example, in certain paper and non-woven containers, the presence of hydrophobic properties is desirable. In these applications, it is required that the durability of the hydrophilic properties be relatively short-term and removable. The length of duration of the hydrophilic properties of the substrate is determined by the particular application and final use of the article.

The particular process of rendering the substrate durably hydrophilic will vary depending on the relative durability of the hydrophilic properties which are desired. Accordingly, the scope of the present invention includes any process for rendering hydrophobic substrates hydrophilic. The particular method of treating the hydrophobic substrate to impart hydrophilic properties will be chosen depending on process and engineering considerations as well as the desired final use or application of the paper or non-woven article. It is only necessary that the hydrophilic properties be durable throughout the paper-making or non-woven making process. While any treatment method for imparting hydrophilic characteristics may be used, a preferred process of treating the hydrophobic substrate is that which is described in detail below.

By "vinyl polymer" as used herein is meant to include homopolymers resulting from the vinyl polymerization of the water-soluble cross-linking vinyl monomers, and co-polymers thereof.

By "cross-linking" vinyl monomer is meant a vinyl monomer having at least two vinyl functional groups.

By "vinyl polymerization" is meant polymerization in which a vinyl group and monomer participates in the formation of a polymer.

The term "paper article" as used herein is meant to include non-woven and paper articles which may be manufactured using conventional paper-making equipment. Such articles include paper, paper towel, paper board, wallpaper, flooring felts, filters, labels, boxes, separators, etc.

Wherever the present disclosure refers to fiber surfaces or intimate contact of the monomer with fiber surfaces or like expressions, it will be understood that the individual fibers are being referred to, such that contact and attachment of the monomer and polymer is with the surfaces of individual fibers of a multifiber thread or bundle.

Polyester is the generic name for a fiber manufactured either as a staple fiber in which the fiber-forming substance is any long chain synthetic polymer composed of at least 85% by weight of an ester of a dihydric alcohol and terephthalic acid. The most common polyester fibers available in the United States are made of polyethylene terephthalate, and are available for example under the trademarks "DARCON" of E. I. duPont de Nemours & Co., "KODEL" of Eastman Chemical Products, Inc. and "FORTREL" of ICI United States, Inc., and from Celanese Chemical Co.

Polyolefin is the name for a group of polymers derived from simple olefins. These materials may be suitably employed as substrates according to the present invention. Non-limiting examples include polyethylene, polypropylene, poly-1-butene and other poly-1-olefins, and copolymers thereof. The preferred polyolefin for use in the present invention is polypropylene.

Polyamides are high molecular weight polymers in which amide linkages (CONH) occur along the molecule chain. Preferred polyamides for use in the present invention are the synthetic linear condensation polyamides. Such polyamides include for example poly(hexamethylene adipamide), which is prepared by the well known reaction of polycarboxylic acid such as adipic acid (or an amide-forming derivative thereof) with a polyamine such as hexamethylene diamine. The most common commercially available polyamides of this type in the United States are nylon 6,6 which is poly(-hexamethylene adipamide), and nylon 6 which is polycaprolactam.

Acrylic is the generic name for fibers in which the fiber-forming substance is any long chain synthetic polymer composed of at least 85% by weight of acrylonitrile units (—$CH_2CH(CN)$—). Such fibers are available in various types of staple fibers and tow, and are commercially available under the trademarks "ORLON" of E. I. duPont Nemours & Co. and "CRESLAN" of American Cyanamid Co., for example.

Polyurethanes may suitably serve as substrate materials for the present invention. Polyurethane is the generic name for thermoplastic as well as thermosetting polymers, produced by the condensation reaction of a polyisocyanate and a hydroxyl-containing material, e.g., a polyol derived from propylene oxide or trichlorobutylene oxide. Such fibers are typically manufactured by the reaction of 4,4'-methylenediphenyl isocyanate and poly(tetramethylene oxide) macroglycol followed by a chain extension reaction.

A variety of halogenated hydrocarbon polymers may serve as substrates for the present process including polyvinyls such as poly(vinyl chloride) and poly(vinyl fluoride), the latter sold under the trademark "TEDLAR" by DuPont Company; polyvinylidenes such as poly(vinylidene chloride) (popularly known as "SARAN") and poly(vinylidene fluoride); copolymers of poly(vinylidene chloride) or poly(vinylidene fluoride) such as the "VITON" trademarked materials which comprise a series of fluoroelastomers sold by DuPont Company based on the copolymerization of vinylidene fluoride and hexafluoropropylene; and fluorocarbon polymers including but not limited to polytetrafluoroethylene, sold by DuPont Company under the trademark "TEFLON". Other halogenated hydrocarbon polymers are known to those skilled in the art.

Non-limiting examples of suitable water-soluble cross-linking vinyl monomers that may be used in this invention include 2,2-bisacrylamidoacetic acid, and esters and salts thereof; 1,1-bisacrylamide-2-methylpropane-2-sulfonic acid and esters and salts N,N'-methylenebisacrylamide, better known by its acronym "MBA"; N,N'-(1,2-dihydroxyethylene)bisacrylamide; and diethylene glycol diacrylate. In some instances, one or more water soluble mono-vinyl monomers may be copolymerized with one or more water-soluble cross-linking vinyl monomers to form the surface polymer according to the present invention. Non-limiting examples of suitable water-soluble monovinyl monomers include acrylamide; acrylic acid; 2-propyn-1-ol; crotonic acid; vinylpyridines; methacrylic acid; 2-acrylamido-2-methylpropanesulfonic acid; methacrylamide; N-methylolacrylamide; N-methyl-N-vinylformamide; N-vinylpyrrolidone; 3-, 4-, or 5-methyl-N-vinylpyrrolidone; maleic acid; vinyloxyethylformamide; acrylonitrile; methacrylonitrile; methallyl alcohol; and styrenesulfonic acid, and water soluble salts thereof. The mono-vinyl monomers may be utilized to improve the hydrophilic properties of the treated substrate. When only a cross-linking monomer is utilized, the resulting product may have a brittle or hard feel or hand. Incorporation of a mono-vinyl compound may further improve the permanency of the treatment by reducing the brittleness of the cross-linked polymer. The use of a functional mono-vinyl monomer may also provide additional dye receptivity to the treated substrate. The amount of mono-vinyl monomer utilized is that sufficient to provide the desired feel or hand while retaining the desired properties imparted by the treatment. Where hand or feel is not important, no mono-vinyl monomer need to be utilized. The preferred water-soluble cross-linking vinyl monomers are N,N'-methylenebisacrylamide, 2,2-bisacrylamidoacetic acid and N,N'-(1,2-dihydroxyethylene)bisacrylamide.

The organic hydrophobic compounds suitable as carriers in the present process may be selected from the following non-limiting categories (1) through (VII) in which n is an integer from 0 to 10 inclusive, it being understood that all non-aromatic carbon-carbon double bonds are saturated:

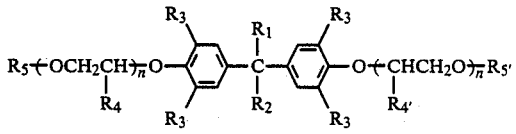

(I)

wherein $R_1$, $R_2$ are independently hydrogen or alkyl, cycloalkyl, alkylaryl, or halohydrocarbyl groups of from one to twenty carbon atoms;

each $R_3$ is independently hydrogen or alkyl;

$R_4$, $R_4$, are independently hydrogen or hydrocarbyl groups of from one to twenty carbon atoms; and $R_5$, $R_5$, are independently hydrogen, hydrocarbyl or halohydrocarbyl groups of from one to thirty carbon atoms, or acyl groups of from one to thirty carbon atoms.

Non-limiting examples of substituents according to Formula I include the following: $R_1$ is ethyl or methyl; $R_2$ is ethyl or methyl; $R_3$ is hydrogen, or acyl groups such as formyl, acetyl, propionyl, butanoyl, isobutanoyl, caproyl and undecanoyl, or alkyl groups such as methyl, ethyl, propyl, butyl and octyl. Preferred compounds according to Formula I include 4,4'-isopropylidenediphenol, better know by its trivial name Bisphenol A; the mono and diethoxylated analogs of Bisphenol A, respective, 4,4'-isopropylidenebis-bis[2-(2-hydroxy-ethoxy)benzene] and 4,4'-isopropylidenebis[2-(2-hydroxyethoxy)ethoxybenzene]; the mono and diethoxylated analogs of Bisphenol A diisobutyrate, respectively, p,p'-isopropylidenebis(2-phenoxyethyl isobutyrate); p,p'-isopropylidenebis(2-phenoxyethoxyethyl isobutyrate); and p,p'-isopropylidenebis(2-phenoxy-1-methylethyl isobutyrate); 4,4'-isopropylidene-bis[3,5-dichloro-4-(2-acetoxyethoxy)benzene]; ethylene oxide; propylene oxide; 4,4'-butylidenebisphenol, better known by its trivial name Bisphenol B.

(II)

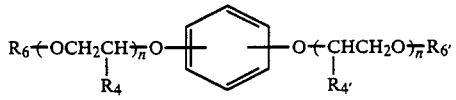

wherein $R_4$, $R_{4'}$, are as defined above; and $R_6$, $R_{6'}$ are independently (i) hydrogen, (ii) alkyl, cycloalkyl, alkylaryl, or halohydrocarbyl groups of from one to twenty carbon atoms, or (iii) alkanoyl, cycloalkanoyl, alkanoylaryl or halohydrocarbanoyl groups of from one to twenty carbon atoms.

Non-limiting examples of suitable hydrophobic carrier compounds according to Formula II include the following para-substituted compounds and meta analogues thereof: p-di(3-hydroxy-1-oxapropyl)benezene; p-di(3-hydroxy-2-methyl-1-oxapropyl)benzene; p-di(6-hydroxy-1,4-dioxahexyl)benzene; p-di(6-hydroxy-2,5-dimethyl-1,4-dioxahexyl)benzene; p-di(3-isobutanoyloxy-1-oxapropyl)benzene; p-di(6-isobutanoyloxy-1,4-dioxahexyl)benzene; p-di(3-acetoxy-1-oxapropyl) benzene; p-di(3-methoxy-1-oxapropyl)benzene; and p-di(6-n-butoxy-1,4-dioxahexyl)-benzene.

(III)

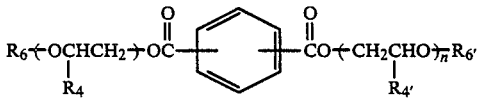

wherein $R_4$, $R_{4'}$, $R_6$ and $R_{6'}$ are as defined above;

(IV)

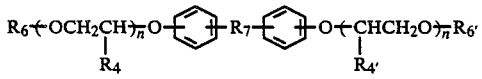

wherein $R_4$, $R_{4'}$, $R_6$ and $R_{6'}$ are as defined above; and $R_7$ is an alkylene group of from one to twenty carbon atoms; an alkyl-, cycloalkyl-, aryl-, aralkyl-, halo- or haloalkyl-substituted alkylene group of from one to twenty carbon atoms; or oxygen, sulfur, C=O or $-SO_2$.

Non-limiting examples of suitable alkylene or substituted alkylene groups as $R_7$ include the following:

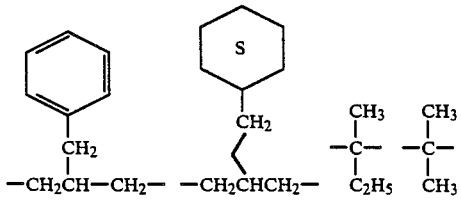

-continued

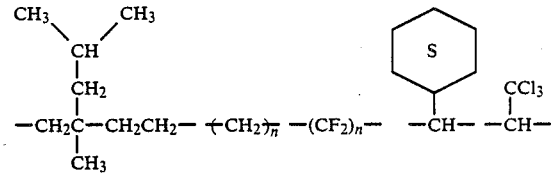

Non-limiting examples of suitable hydrophobic carrier compounds according to Formula IV include the following: 4,4'-isopropylidenebis[(3-hydroxy-1-oxapropyl)benzene]; 4,4'-isopropylidenebis[(6-hydroxy-1,4-dioxahexyl)benzene]; 4,4'-isopropylidenebis[(9-hydroxy-1,4,7-trioxanonyl)benzene]; 4,4'-isopropylidenebis[(3-hydroxy-2-methyl-1-oxapropyl)benzene]; 4,4'-isopropylidenebis[(6-hydroxy-2,5-dimethyl-1,4-dioxahexyl)benzene]; 4,4'-isopropylidenebis[(9-hydroxy-2,5,8,-trimethyl-1,4,7-trioxanonyl) benzene]; 4,4'-isopropylidenebis[(6-acetoxy-1,4-dioxahexyl)benzene]; 4,4'-isopropylidenebis[(9-acetoxy-2,5,8-trioxanonyl)benzene]; 4,4'-isopropylidenebis[(6-isobutanoyloxy-1,4,-dioxahexyl)-benzene]; 4,4'-isopropylidenebis[(9-isobutanoyloxy-1,4,7-trioxanonyl)-benzene]; 4,4'-butylidenebis[(6-hydroxy-1,4-dioxahexyl)benzene]; 4,4-oxobis[(6-hydroxy-1,4-dioxahexyl)-benzene].

(V)

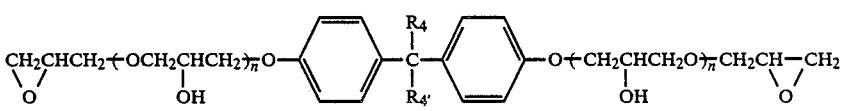

wherein $R_4$ and $R_{4'}$ are defined as above.

(VI)

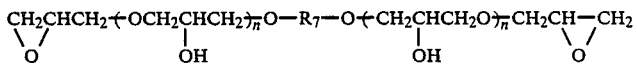

wherein $R_7$ is defined as above, but is not oxygen, sulfur, C=O or $SO_2$.

(VII)

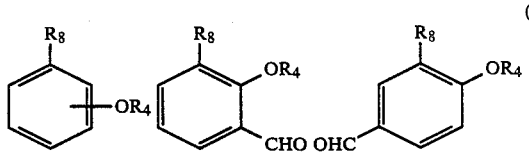

wherein $R_4$ is defined as above; and $R_8$ is hydrogen, or an alkyl, cycloalkyl, alkylaryl or halohydrocarbyl group of from one to thirty carbon atoms.

Non-limiting examples of suitable hydrophobic carrier compounds according to Formula VII include the following: p-nonylphenyl 2-hydroxyetyl ether; o-nonylphenyl 2-hydroxyethyl ether; p-dodecylphenyl 5-hydroxy-3-oxapentyl ether; o-dodecylphenyl 5-hydroxy-3-oxapentyl ether; p-nonylphenyl 5-isobutanoyloxy-3-oxapentyl ether; 2-(3-hydroxy-1-oxapropyl)-5-dodecylbenzaldehyde; 2-(6-isobutanoyloxy-1,4-dioxahexyl)-5-heptylbenzaldehyde; 3-nonyl-4-(6-hydroxy-1,4-dioxahexyl)benzaldehyde.

The hydrophobic carrier compounds are preferably emulsifiable. A plurality of such carrier compounds may be used.

We have found surprisingly that the hydrophobic carrier compound need not contain the vinyl function. Illustrative non-vinyl hydrophobic molecules particularly effective as carrier compounds in the present process include non-polymerizable molecules such as di-, tri- and higher ethoxylated Bisphenol A. Also particularly effective is ethoxylated Bisphenol A diisobutyrate. Illustrative polymerizable non-vinyl hydrophobic compounds include 1,4-butanediol diglycidiyl ether and epoxy resins such as the resin "D.E.R. 331" available from Dow Chemical Company:

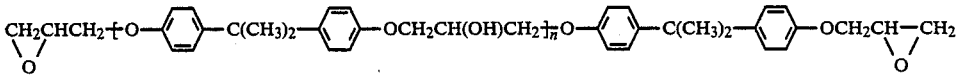

Prior to the polymerization of the water-soluble cross-linking vinyl monomer, the aqueous mixture is contacted with the substrate. Preferably, a suitable emulsion of the carrier compound and the vinyl monomer should be formed, with such emulsion contacting the substrate. By suitable emulsion as used herein is meant an emulsion in which no droplets are visible to the naked eye. Normally, in accordance with the present invention, the initial emulsion may be milky in appearance. This milky appearance may be clarified somewhat or clarified completely as the carrier compound is withdrawn from the emulsion to the substrate.

In the absence of the contact of carrier compound with the substrate, the polymer derived from the water-soluble vinyl monomer is relatively loosely affixed to the substrate and most of the improved properties attributable to this polymer are rapidly lost during washing. This is especially true for hydrophobic substances such as polypropylene, polyester and poly(vinyl chloride).

Polymers prepared from polymerizable hydrophobic carrier compounds alone do not have the desirable surface properties achieved by the polymers of the present invention. Moreover, we have found that non-polymerizable compounds such as ethoxylated Bisphenol A diisobutyrate are effective as hydrophobic carriers.

For self-emulsifying carrier compounds, it may not be necessary to first form an emulsion thereof prior to contacting the substrate. However, in the case where an emulsifier is utilized, an appropriate concentration of emulsifying agent or surfactant should be used. If the concentration is too low, there will not be a suitable emulsion and there will not be even intimate contact betweeen the hydrophobic carrier and the substrate. It is preferred to eliminate the deposition of globs of visible particles of carrier.

There is preferably a period of time prior to the polymerization reaction when the aqueous mixture is dispersed adjacent to the substrate so that adequate contact between the carrier and the substrate is achieved. This period of time can vary greatly, and is normally between about 30 seconds to as much as about 30 minutes.

The basic structure of a surfactant contains two distinct elements, the hydrophobic and hydrophilic portions. Hydrocarbons containing chains of 8 to 20 carbon atoms offer suitable hydrophobes. Hydrophobes can include aliphatic compounds, that are either saturated or unsatruated and/or aromatic compounds. Hydrophobes can also contain oxygen or halogen atoms. Among commonly used hydrophobes are long straight chain alkyl groups, long branched chain alkyl groups, long chain alkylbenzenes, alkylnaphthalenes, rosin and lignin derivatives, high molecular weight propylene oxide polymers, long chain perfluoroalkyl groups, polysiloxane groups, and perfluorinated compounds. Common sources of hydrophobes would include tallow, coconut oil, tall oil, cotton seed oil, safflower oil, mineral oil, alkyleenzenes, diphenyl oxide, naphthalene formaldehyde condensates and lignin.

Among commonly used hydrophilic groups are the anionic, cationic, nonionic and amphoteric. The anionic groups would include carboxylate, sulfate, sulfonate, and phosphate esters. The cationic groups would include salts of primary amines, salts of secondary amines, salts of tertiary amines and quaternary ammonium compounds. The nonionic groups would include ethylene oxide adducts or other hydrophilic polymers that carry no electrical charge. The amphoteric groups would include surfactants that contain both acidic and basic hydrophilic groups that would function either as anionic or cationic depending on the pH of the solution.

A wide variety of surfactants can be used in the present invention. Examples include anionic surfactants such as alkyl sulfonate, alkyl sulfate, sulfated oil or fat, sulfated glycol ester, sulfated alkanolamide, sulfated alkylphenol polyglycol sodium xylenesulfonate, sodium dibutylnaphthalenesulfonate, sodium dodecylbenzenesulfonate, sodium sulfonate of naphthalene formaldehyde condensate, sulfonated amide, monoalkyl phosphate salt, dialkyl phosphate salt, trialkyl phosphate, neutralized carboxylic acids (i.e. sodium stearate) and sulfated ethers.

Suitable surfactants also include amphoteric examples such as alkylglycine, N-alklybetaine, imidazoline, glycine, sulfated polyglycol amine, and alkylamine sulfonate. Further suitable surfactants include cationic examples such as quaternary ammonium compounds, fatty amine salts, alkylamine polyoxyethanol glycols, (fatty alkyl)dimethylbenzylammonium chloride, lauryl-pyridinium chloride, N-acyl-N'-hydroxyethylethylene diamine, N-alkyl-N'-hydroxyethylimidazoline and amino amides. Nonionic surfactants may also be used. Suitable examples include ethoxylated fatty alcohols, ethoxylated long branched chain alcohols, and ethoxylated alkylaryl alcohols, and ethoxylated fatty amines. Other suitable nonionic surfactants include polyethylene glycol esters and polyethylene glycol amides.

The choice of surfactant and the amount of surfactant would be limited to those that do not significantly interfere with the polymerization reaction and interaction between the water-soluble cross-linking vinyl monomer, the hydrophobic carrier compound and the substrate. The preferred surfactants are the anionic and the nonionic surfactants. It has been found that some of the cationic (i.e. primary, secondary and tertiary amines) may interfere with the present invention under some reaction conditions. The determination of whether a given surfactant or the amount of a surfactant significantly interferes with polymerization may be accomplished by routine preliminary testing within the skill of one of ordinary skill in the art.

The choice of the polymerization initiator would depend on the type of water-soluble monomer and hydrophobic carrier compound, on the temperature of polymerization and on other parameters.

A physical impetus may be used to polymerize the water-soluble monomer. Examples of physical impetus include photochemical initiators, such as ultraviolet radiation, or ionizing radiation, such as gamma rays and fast electrons. By the term "initiator" we mean any chemical or physical impetus or combination thereof that will start and maintain a vinyl polymerization of the monomer.

Non-limiting examples of polymerization initiators that may be utilized in this invention include inorganic peroxides, e.g., hydrogen perioxide, barium perioxide, magnesium perioxide, etc., and various organic peroxy compounds, illustrative examples of which are the dialkyl peroxides, e.g. diethyl peroxide, dipropyl peroxide, dilauryl peroxide, dioleyl peroxide, distearyl peroxide, di-(tert.-butyl) peroxide and di-(tert.-amyl) peroxide, such peroxides often being designated as ethyl, propyl, lauryl, oleyl, stearyl, tert.-butyl and tert.-amyl peroxides; the alkyl hydrogen peroxides, e.g. tert.-butyl hydrogen peroxide (tert.-butyl hydroperoxide), tert.-amyl hydrogen peroxide (tert.-amyl hydroperoxide), etc., diacyl peroxides, such as acetyl peroxide, propionyl peroxide, lauroyl peroxide, stearoyl peroxide, benzoyl peroxide, etc., fatty oil acid peroxides, e.g., coconut oil peroxides, etc., unsymmetrical or mixed diacyl peroxides, e.g. acetyl benzoyl peroxide, propionyl benzoyl peroxide, etc., terpene oxides, e.g., ascaridole, etc., and salts of inorganic peracids, e.g., ammonium persulfate and potassium persulfate.

Initiators also include ceric ions, for example, in the form of ceric salts such as ceric nitrate, ceric sulfate, ceric ammonium nitrate, ceric ammonium sulfate, ceric ammonium pyrophosphate, ceric iodate, and the like. Non-limiting examples of suitable acids for use in the present invention include hydrochloric, phosphoric, sulfuric, nitric, acetic, formic, oxalic, tartaric, monochloroacetic, dichloracetic, trichloroacetic and similar acids.

The polymerization should preferably occur at an appropriate hydronium ion concentration. The acids listed above, namely hydrochloric, phosphoric, sulfuric, nitric, acetic, formic, oxalic, tartaric, monochloroacetic, dichloroacetic, trichloroacetic and similar acids may function as a reagent to control the hydronium ion concentration or pH. In addition, bases such as potassium hydroxide and sodium hydroxide may be required to control pH. The pH may range during polymerization from about 1 to about 13, preferably from about 2.5 to about 12.5, and most preferably from about 2.5 to about 4.0.

The time duration for the polymerization of the water-soluble vinyl polymer following initiation should be between about 30 seconds and 30 minutes. Generally, the time duration is not critical, but the time should be sufficient for the polymerization to take place to the desired extend. While the process of the present invention may be used at any of a number of stages during the usual processing of polymer fibers or fabrics, or other substrates, it has been found preferable to use the process before the dyeing of the fibers or before there is any treatment of the fibers which would result in encapsulation or coating of the fiber surface. It is common practice to encapsulate or "lock on" the dye or other fiber treatment chemicals, and such coating may often interfere with the present process. To the extent that there would still be improvement in surface properties, the improvement would be gradually washed off through repeated washings.

It is preferable that the fibers be scoured and rinsed prior to carrying out the treatment process of the present invention in order to remove soil, finish oils, and other contaminants which may be present on the fibers.

Uniform dispersal and intimate contact of all chemicals during the process of the present invention is preferred. In the case of fibers this may be assisted by various forms of agitation or flow of the aqueous treating mixture around and between the fiber surfaces.

The time necessary for attaining uniform dispersal, intimate contact and attachment onto the substrate will vary with the particular method of contacting the substrate with the aqueous mixture, and may range from one second to thirty minutes. Although it is possible that the aqueous mixture could be contacted with the fibers by spraying, paddling, dipping or other means, it is most preferable to immerse the fibers in a bath formed by the mixture. Using such immersion techniques, relatively short periods of time are necessary before polymerization may begin. For example, about 10 minutes is usually sufficient with adequate agitation or circulation of the aqueous mixture.

The process can be controlled by restricting any one or more of the controlling factors of heat, time, initiator, pH, or by restricting addition of the water-soluble cross-linking vinyl monomer and/or hydrophobic carrier compound. Thus, by way of example and not by way of limitation, the monomer, carrier, acid, and substrate may be placed in an aqueous medium with agitation, with the aqueous medium being brought up to the appropriate temperature. The polymerzation process can then be triggered by the addition of the initiator.

An alternative example would be to assemble the water-soluble monomer, carrier, acid, initiators and substrate in an aqueous medium and maintain the same at a temperature below the polymerization temperature. The polymerization process could then be triggered by raising the temperature. The substrate after being cleaned is immersed in the aqueous mixture. The temperature is non-critical as long as a threshhold temperature sufficient to effect polymerization with the components at the concentration of the components is achieved. Generally, a temperature range between about 40° C. and about 100° C. is suitable. The temperature range from about 80° C. to about 100° C. is preferred, with about 90° C. to about 95° C., lower concentrations of components can be used particularly the preferred initiator, potassium persulfate. Some of the initiators, such as potassium persulfate under the conditions used, will not readily initiate a vinyl polymerization at a temperature as low as 40° C. However, other initiators will initiate vinyl polymerization at a temperature of as low as 40° C. and perhaps even lower. In most cases, the threshhold temperature is dependent upon the components, their concentration, pH and particularly the nature of the initiator.

In a preferred embodiment, the substrate is first immersed within the water after being cleaned. The water may be at ambient temperature, or may be heated as to within the range of about 40° C. to 100° C. Thereafter, the hydrophobic carrier compound and the emulsifying agent are added to the water. A suitable weight percentage range for the hydrophobic carrier compound is normally between about 0.02 to 2.0 weight percent on weight of substrate and a suitable weight percentage range for the emulsifying agent is any weight percentage range that achieves an emulsion that remains suitable throughout the process of the present invention, as "suitable" has been heretofore defined. The upper and lower limits of concentration for the hydrophobic carrier compound may be determined for any given combination of substrate, water soluble vinyl monomers carrier, initiators, acids and temperature by routine testing to determine durability of retention of improved surface properties. The system is agitated for a sufficient period of time for dispersal and contact of the components with the substrate prior to addition of water-soluble cross-linking vinyl monomer. A period of time of between about 30 seconds to 30 minutes may be used. Routine testing may be used to determine a satisfactory time period.

The system is preferably maintained under agitation throughout the process. Such agitation will result in better emulsification and dispersal of the hydrophobic carrier compound, so that a suitable emulsion thereof is obtained.

Acid and water-soluble cross-linking vinyl monomer are then added to complete the aqueous mixture. The monomer is present in a concentration between preferably about 0.002 and about 10 weight percent on weight of the substrate. The concentration of the monomer is normally not critical in terms of a desirable product, and may be varied. Upper and lower limits may be readily determined by routine testing for improved surface properties of the substrate. With some emulsifiers, it may be necessary to remove the substrate from the treatement bath, rinse out excess emulsifier, and re-immerse the emulsion-laden substrate in a fresh water bath prior to addition of the water-soluble cross-linking monomer and acid in order to achieve optimal results.

The weight percentage concentration of the acid will depend upon the nature of the acid. This is readily determinable by simple tests within the skill of one having ordinary skill in the art. By way of example, suitable concentrations for hydrochloric acid are such that a pH between about 2.5 and about 4.0 is achieved in the aqueous mixture. At a pH of 2 of below, a spontaneous free radical polymerization may take place. Such a higher acid concentration effect is known to the art. Initiator is then added to the aqueous mixture in an amount sufficient to initiate polymerization of the cross-linking vinyl monomer.

The particular concentrations of the water-soluble cross-linking vinyl monomer, carrier compound, acid and the initiator in the treatment system will vary widely depending upon such factors as the nature of the particular components, the time and temperature of the treatment, and the nature of the substrate being treated. While certain concentrations, acids, and initiators may be needed under a given set of treatment conditions, Applicants cannot give general ranges which would apply to all monomers, carrier compounds, acids and initiators under all conditions, but those of ordinary skill in the art will be able to optimize the concentrations by routine experimentation on the basis of the present disclosure.

Attaining the desired degree of treatment according to this invention depends on the strength of the initiator, or the concentration of the water-soluble monomer and carrier compound, and on the pH. Thus, for example, a strong initiator, as for example a free radical initiator that forms relatively high concentrations of free radicals and/or a high weight concentration of initiator, could require a lower concentration of water-soluble vinyl monomer. Conversely, a weak initiator, that is, as initiator which creates active initiating free radicals at a slower rate than a strong initiator under given polymerization conditions, would require a higher monomer concentration. The treatment according to this invention can be controlled by draining the initiator-containing solution from the fibers once the desired extent of polymerization has been achieved.

The rate of polymerization is a function of the concentration of acid, water-soluble cross-linking vinyl monomer, carrier, substrate, and initiator. It is also a function of temperature and type of equipment being used. The substrate is allowed to remain in the treating solution at a temperature high enough and for a period of time long enough to assure that uniform polymerization ("substantial polymerization") has occurred, such time usually being between about 30 seconds and about 30 minutes. The fibers can then be rinsed with water to remove excess homopolymers, if any.

The process ma be processed on a continuous basis by the sequential introduction of the fibers to be treated into baths containing the carrier compound and water-soluble vinyl monomer either in a single bath or sequentially and then subsequently introducing the substrate into a bath containing the polymerization initiator which is maintained at a suitable temperature.

The synthetic fibers of the present invention are treated to render them durably hydrophilic. These fibers are superior to conventional hydrophilic synthetic fibers since their durably hydrophilic, absorbent characteristics permit easier mixing into the paper-making slurry due to an increased density and an increased affinity for water bonding and permits the formation of non-woven or paper articles that are both fully absorbent and reusable after drying.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of making paper or non-woven articles, comprising:

(i) treating a fiber substrate to render said substrate durably hydrophilic, wherein said treating step comprises:

(a) contacting said substrate with an aqueous mixture at a temperature between about 40° C. and about 100° C. containing an effective amount of a water-soluble cross-linking vinyl monomer and an effective amount of an organic hydrophobic carrier compound having a greater affinity for the substrate than the surrounding aqueous mixture, all non-aromatic carbon-carbon bonds of said carrier compound being saturated; and (b) thereafter initiating polymerization of said water-soluble cross-linking monomer to form a vinyl polymer on said substrate whereby the hydrophilic properties of said substrate are improved; and (ii) forming said durable hydrophilic substrate into a paper or non-woven article on papermaking equipment.

2. The method of claim 1, wherein said aqueous mixture is maintained under agitation in step (a).

3. The method of claim 1, wherein the aqueous mixture is a suitable aqueous emulsion containing a water-soluble cross-linking vinyl monomer, and a hydrophobic carrier compound which is emulsifiable.

4. The method of claim 3, wherein the temperature during polymerization is between about 80° C. and about 100° C.

5. The method of claim 4, wherein the temperature during polymerization is between about 90° C. and about 95° C.

6. The method of claim 3, wherein the carrier compound has the formula:

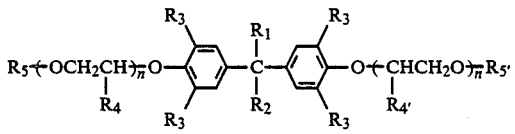

wherein n is an integer from zero to ten;

$R_1$ and $R_2$ are independently selected from the group consisting of hydrogen and alkyl, cycloalkyl, alkylaryl and halohydrocarbyl groups containing from 1 to 20 carbon atoms;

each $R_3$ is independently hydrogen or alkyl;

$R_4$ and $R_{4'}$ are independently selected from the group consisting of hydrogen and hydrocarbyl groups containing from 1 to 20 carbon atoms; and $R_5$ and $R_{5'}$ are independently selected from the group consisting of hydrogen, hydrocarbyl and halohydrocarbyl group containing from 1 to 30 carbon atoms, and acyl groups containing from 1 to 30 carbon atoms.

7. The method of claim 3, wherein the carrier compound has the formula:

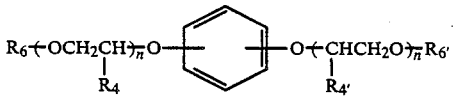

wherein n is an integer from zero to ten;

$R_4$ and $R_{4'}$ are independently selected from the group consisting of hydrogen and hydrocarbyl groups containing from 1 to 20 carbon atoms; and $R_6$ and $R_{6'}$ are independently selected from the group consisting of (i) hydrogen, (ii) alkyl, cycloalkyl, alkylaryl and halohydrocarbyl groups containing from 1 to 20 carbon atoms, and (iii) alkanoyl, cycloalkanoyl, arylalkanoyl and halohydrocarbanoyl groups containing from 1 to 20 carbon atoms.

8. The method of claim 3, wherein the carrier compound has the formula:

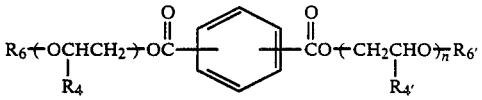

wherein n is an integer from zero to ten;

$R_4$ and $R_{4'}$ are independently selected from the group consisting of hydrogen and hydrocarbyl groups containing from 1 to 20 carbon atoms; and $R_6$ and $R_{6'}$ are independently selected from the group consisting of (i) hydrogen, (ii) alkyl, cycloalkyl, alkylaryl and halohydrocarbyl groups containing from 1 to 20 carbon atoms, and (iii) alkanoyl, cycloalkanoyl, arylalkanoyl, and acylhalohydrocarbanoyl groups containing from 1 to 20 carbon atoms.

9. The method of claim 3, wherein the carrier compound has the formula:

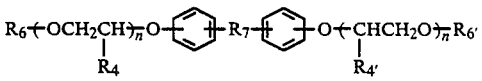

wherein n is an integer from zero to ten;

$R_4$ and $R_{4'}$ are independently selected from the group consisting of hydrogen and hydrocarbyl groups containing from 1 to 20 carbon atoms;

$R_6$ and $R_{6'}$ are independently selected from the group consisting of (i) hydrogen, (ii) alkyl, cycloalkyl, alkylaryl and halohydrocarbyl groups containing from 1 to 20 carbon atoms, and (iii) alkanoyl, cycloalkanoyl, arylalkanoyl and halohydrocarbanoyl groups containing from 1 to 20 carbon atoms; and $R_7$ is selected from the group consisting of alkylene, alkylalkylene, cycloalkylene, arylalkylene, haloalkylenyl and haloalkylalkylene groups containing from 1 to 20 carbon atoms, oxygen, sulfur, C=O and $-SO_2-$.

10. The method of claim 3, wherein the carrier compound has the formula:

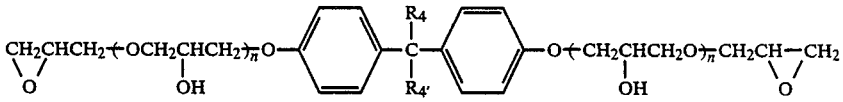

wherein n is an integer from zero to ten;

$R_4$ and $R_{4'}$ are independently selected from the group consisting of hydrogen and hydrocarbyl groups containing from 1 to 20 carbon atoms; and $R_6$ and $R_{6'}$ are independently selected from the group consisting of (i) hydrogen, (ii) alkyl, cycloalkyl, alkylaryl and halohydrocarbyl groups containing from 1 to 20 carbon atoms, and (iii) alkanoyl, cycloalkanoyl, arylalkanoyl and halohydrocarbanoyl groups containing from 1 to 20 carbon atoms.

11. A process according to claim 3, wherein the carrier compound has the formula:

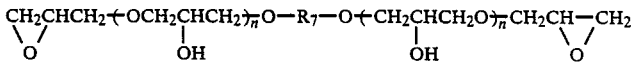

wherein n is an integer from zero to ten; and $R_4$ and $R_{4'}$ are independently selected from the group consisting of hydrogen and hydrocarbyl groups containing from 1 to 20 carbon atoms.

n is an integer from zero to ten; and $R_7$ is selected from the group consisting of (i) alkylene groups containing from 1 to 20 carbon atoms and (ii) alkyl-, cycloalkyl-, aryl-, aralkyl-, halo- and haloalkyl-substituted alkylene groups of from to 20 carbon atoms.

12. The method of claim 3, wherein the carrier compound is a member of the group consisting of

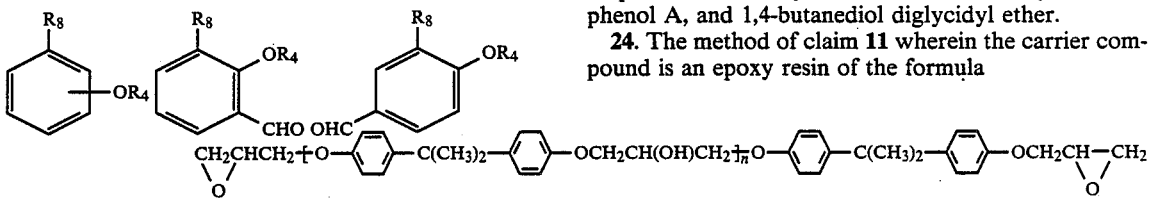

wherein $R_4$ is selected from the group consisting of hydrogen and hydrocarbyl groups containing from 1 to 20 carbon atoms; and $R_8$ is selccted from the group consisting of hydrogen and alkyl, cycloalkyl, alkylaryl and halohydrocarbyl groups containing from 1 to 30 carbon atoms.

13. The method of claim 3, wherein the suitable emulsion contains an emulsifying agent of a composition which does not adversely interfere with the process and which is present in an amount sufficient to maintain said suitable aqueous emulsion but not enough to adversely interfere with said process.

14. The method of claim 13, wherein step (a) comprises the steps of:

(i) immersing the substrate in water;

(ii) adding the hydrophobic carrier compound and emulsifying agent to the water to form an aqueous emulsion of the hydrophobic carrier compound;

(iii) agitating the system for a sufficient time for dispersal and contact of the components to occur; and (iv) adding water soluble vinyl monomer.

15. The method of claim 13, wherein the substrate is rinsed, after step (iii) to remove excess emulsifying agent.

16. The method of claim 11 in which the initiation of polymerization in step (b) is achieved by a chemical initiator.

17. The method of claim 11 in which the initiation of polymerization in step (b) is achieved by a physical impetus which starts and maintains polymerization.

18. The method of claim 11 wherein the suitable aqueous emulsion in step (a) is maintaine below the polymerization temperature and contains an initiator which is activated by raising the temperature above the polymerization temperature in step (b).

19. The method of claim 11 in which the water-soluble cross-linking vinyl monomer is present in a concentration of between about 0.002 to 10 weight percent on weight of the substrate.

20. The method of claim 11 in which the hydrophobic carrier compound is present in the suitable aqueous emulsion in a concentration of between about 0.02 to 2.0 weight percent on weight of the substrate.

21. The method of claim 11 in which the suitable aqueous emulsion is in contact with the substrate for at least about 30 seconds to 30 minutes prior to initiating polymerization.

22. The method of claim 11 in which polymerization is achieved within about 30 seconds to about 30 minutes after initiation in step (b).

23. The method of claim 11 wherein the carrier compound is selected from the group consisting of 5-hydroxy-3-oxapentyl terephthalate, diethoxylated Bisphenol A, triethoxylated Bisphenol A, hexaethoxylated Bisphenol A, isobutyric acid ester of ethoxylated Bisphenol A, and 1,4-butanediol diglycidyl ether.

24. The method of claim 11 wherein the carrier compound is an epoxy resin of the formula wherein n is an integer from zero to ten.

25. The method of claim 24 wherein the water-soluble cross-linking vinyl monomer is N,N'-methylenebisacrylamide.

26. The method of claim 11 in which the hydrophobic carrier compound is present in the suitable aqueous emulsion in a concentration of between about 0.02 to 2.0 weight percent on weight of the substrate.

27. The method of claim 11, in which the concentration of the water-soluble cross-linking vinyl monomer in the suitable substrate is between about 0.002 and about 10 weight percent on weight of the substrate, the concentration of the hydrophobic carrier compound is between about 0.02 and about 2.0 weight percent on weight of the substrate, the suitable aqueous emulsion is in contact with the substrate for about 30 seconds to about 30 minutes prior to initiating polymerization and the polymerization is achieved within about 30 seconds to about 30 minutes after initiation.

28. The method of claim 27 wherein the water-soluble cross-linking vinyl monomer is N,N'-methylenebisacrylamide and the hydrophobic carrier compound is isobutyric acid ester of ethoxylated Bisphenol A.

29. The method of claim 1, wherein said substrate is a fiber.

30. The method of claim 29, wherein said fiber is a staple fiber.

31. The method of claim 1, wherein the substrate is polyester.

32. The method of claim 1, wherein the substrate is a polyolefin.

33. The method of claim 32, wherein the polyolefin is polypropylene.

34. The method of claim 1, wherein the substrate is a polyamide.

35. The method of claim 34, wherein the poyamide is selected from the group consisting of nylon 6 and nylon 6,6.

36. The non-woven or paper article prepared in accordance with the process of claim 1.

37. The polyester non-woven or paper article prepared in accordance with the process of claim 31.

38. The polyolefin non-woven or paper article prepared in accordance with the process of claim 32.

39. The polyamide non-woven or paper article prepared in accordance with the process of claim 34.

* * * * *